US006843739B2

(12) United States Patent
Putnam

(10) Patent No.: US 6,843,739 B2
(45) Date of Patent: Jan. 18, 2005

(54) PORTABLE PITCHING MOUND

(75) Inventor: Steve Putnam, Sandyville, OH (US)

(73) Assignee: Stephen P. Putnam, Sandyville, OH (US)

( * ) Notice: Subject to any disclaimer, the term of this patent is extended or adjusted under 35 U.S.C. 154(b) by 0 days.

(21) Appl. No.: 10/155,509

(22) Filed: May 24, 2002

(65) Prior Publication Data

US 2003/0220161 A1 Nov. 27, 2003

(51) Int. Cl.[7] ..... A63B 71/00; A63B 69/00

(52) U.S. Cl. ..... 473/497; 473/499; 473/451; 473/452

(58) Field of Search ..... 473/497, 499–501, 473/451, 150, 218, 270, 225, 414

(56) References Cited

U.S. PATENT DOCUMENTS

| | | | | |
|---|---|---|---|---|
| 3,236,520 A | | 2/1966 | Friedman | |
| 3,427,031 A | | 2/1969 | Scott | |
| 3,479,028 A | | 11/1969 | Goeders | |
| 3,837,646 A | * | 9/1974 | Goeders | 473/497 |
| D236,219 S | | 8/1975 | Goeders | |
| 4,063,729 A | | 12/1977 | Hollaway | |
| D258,903 S | | 4/1981 | Goeders | |
| 4,306,718 A | | 12/1981 | Goeders | |
| 4,561,653 A | | 12/1985 | Wright | |
| 4,666,155 A | | 5/1987 | Stille | |
| 4,749,223 A | | 6/1988 | Goeders | |
| 4,779,796 A | | 10/1988 | Lai | |
| D304,359 S | | 10/1989 | Wright | |
| 4,925,186 A | | 5/1990 | Stevenson et al. | |
| 4,978,121 A | * | 12/1990 | Larkey | 473/454 |
| D315,382 S | | 3/1991 | Ragsdale | |
| 5,058,889 A | | 10/1991 | Burton | |
| 5,213,323 A | | 5/1993 | Novinsky | |
| 5,467,977 A | | 11/1995 | Beck | |
| 5,624,112 A | | 4/1997 | Hummel et al. | |
| D388,849 S | | 1/1998 | Goeders | |
| 5,707,305 A | | 1/1998 | Goeders et al. | |

* cited by examiner

*Primary Examiner*—Mitra Aryanpour
(74) *Attorney, Agent, or Firm*—Benesch, Friedlander, Coplan & Aronoff LLP

(57) ABSTRACT

An apparatus includes a base unit having a top surface, a collapsible ramp connected to the base unit movable between an extended orientation sloping from the base unit to a playing surface and a storage orientation and indicia for designating a player's location on the top surface of the base unit.

10 Claims, 7 Drawing Sheets

PORTABLE PITCHING MOUND

BACKGROUND OF THE INVENTION

The present invention relates generally to training or practice equipment. It finds particular application in a baseball environment as a pitcher's mound and will be described with particular reference thereto. However, it is to be appreciated that the present invention is also amenable to other applications where a compact, portable ramp is desired.

Because practicing is a major component of excelling in any sport, it is critical to a player and coach to simulate accurate game-like conditions while practicing. Specifically, when practicing and warming-up for pitching, it is important for the player to be able to simulate the conditions and variables normally faced in game situations. One very critical component of the game of baseball is the pitcher's mound. The official rules of the game regulate the pitching mound dimensions corresponding to the sport and more specifically, the league of the sport being played. For example, the height of the pitching mound, the dimensions of the pitcher's rubber and even the slope of the front of the mound are just a few defined constants that are regulated by the official rules of the sport. When accurately reproduced on a practice field, the pitcher will become accustomed to game-like conditions thus focusing on perfecting the mechanics of the art of pitching.

Whether due to darkness, winter seasons or inclement weather, many times, actual outdoor field practice is prohibited. Sometimes when outdoor practice is not practical, it is possible to practice indoors. However, practicing indoors is generally not conducive to replicating game-like conditions as the regulation pitching mound is usually not available indoors.

Prior art workers have devised many types of portable pitching mounds. For the most part, the prior art portable pitching mounds comprise bulky molded fiberglass shells in part, at least, covered with a resilient material, an artificial turf material, or the like. Examples of such mounds are taught in U.S. Pat. Nos. 4,306,718 and 4,749,223.

The present invention overcomes problems in the prior art and others.

SUMMARY OF THE INVENTION

In accordance with one embodiment of the present invention, a practice device includes a base unit having a top surface, a ramp connected to the base unit movable between an extended orientation sloping from the base unit to a playing surface and a storage orientation and a means for designating a player's location on the top surface of the base unit.

In accordance with another aspect of the present invention, the device further includes a handle connected to, integral with, or molded into the base unit.

In accordance with another aspect of the present invention, the device further includes a carrying strap connected to the base unit.

In accordance with another aspect of the present invention, the ramp is collapsible from the extended orientation to the storage orientation where the ramp in the storage orientation is comparably sized to the base unit.

In accordance with another aspect of the present invention, the device further comprises a home plate removably attached to the base unit.

In accordance with another aspect of the present invention, the device further comprises a means for measuring a distance from a designated location on the base unit to a location on a playing surface such as a tape measure and the like.

In accordance with another aspect of the present invention, the device further comprises a means for anchoring the base unit to a playing surface such as a spike, rubber mat, and the like.

In accordance with another aspect of the present invention, designating means comprises a pitching rubber such as a replaceable rubber corresponding to the practice event.

In accordance with another embodiment of the present invention, a portable pitching mound includes a base having an upper surface and a lower surface, and a connected handle. A ramp is removably connected to the upper surface and angles between the upper surface of the base and a playing surface. A pitching rubber is connected to the upper surface of the base and a retractable measuring device is provided that measures a distance from the pitching rubber to a location on a playing surface.

In accordance with another aspect of the present invention, the pitching mound includes a height adjusting mechanism connected to the lower surface of the base.

In accordance with another aspect of the present invention, the ramp is collapsible.

In accordance with another aspect of the present invention, the base includes a lateral movement inhibitor such as a spike, a non-slip pad and the like.

In accordance with another aspect of the present invention, a device comprises a platform, and a collapsible ramp removably connected to one side of the platform where the collapsible ramp forms a top to the platform when the device is in a stored configuration. A pitching rubber is connected to said platform and a target such as a home plate is removably attached to the platform opposite the collapsible ramp. A measuring device capable of measuring a distance between the pitching rubber and the target when the device is deployed on a playing surface is also provided. Operatively connected to the device, a means for reducing slippage, such as a rubber pad, is also included.

In accordance with another aspect of the present invention, the measuring device includes a tape measure and the like.

In accordance with another aspect of the present invention, means for reducing slippage includes a spike and the like.

The above aspects and other embodiments, features, and advantages of the present invention are more readily understood from a review of the attached drawings and the accompanying specification and claims.

BRIEF DESCRIPTION OF THE DRAWINGS

The invention may take form in various components and arrangements of components. The drawings are only for the purposes of illustrating the preferred embodiments and are not to be construed as limiting the invention.

DETAILED DESCRIPTION OF THE PREFERRED EMBODIMENTS

Figure 1:
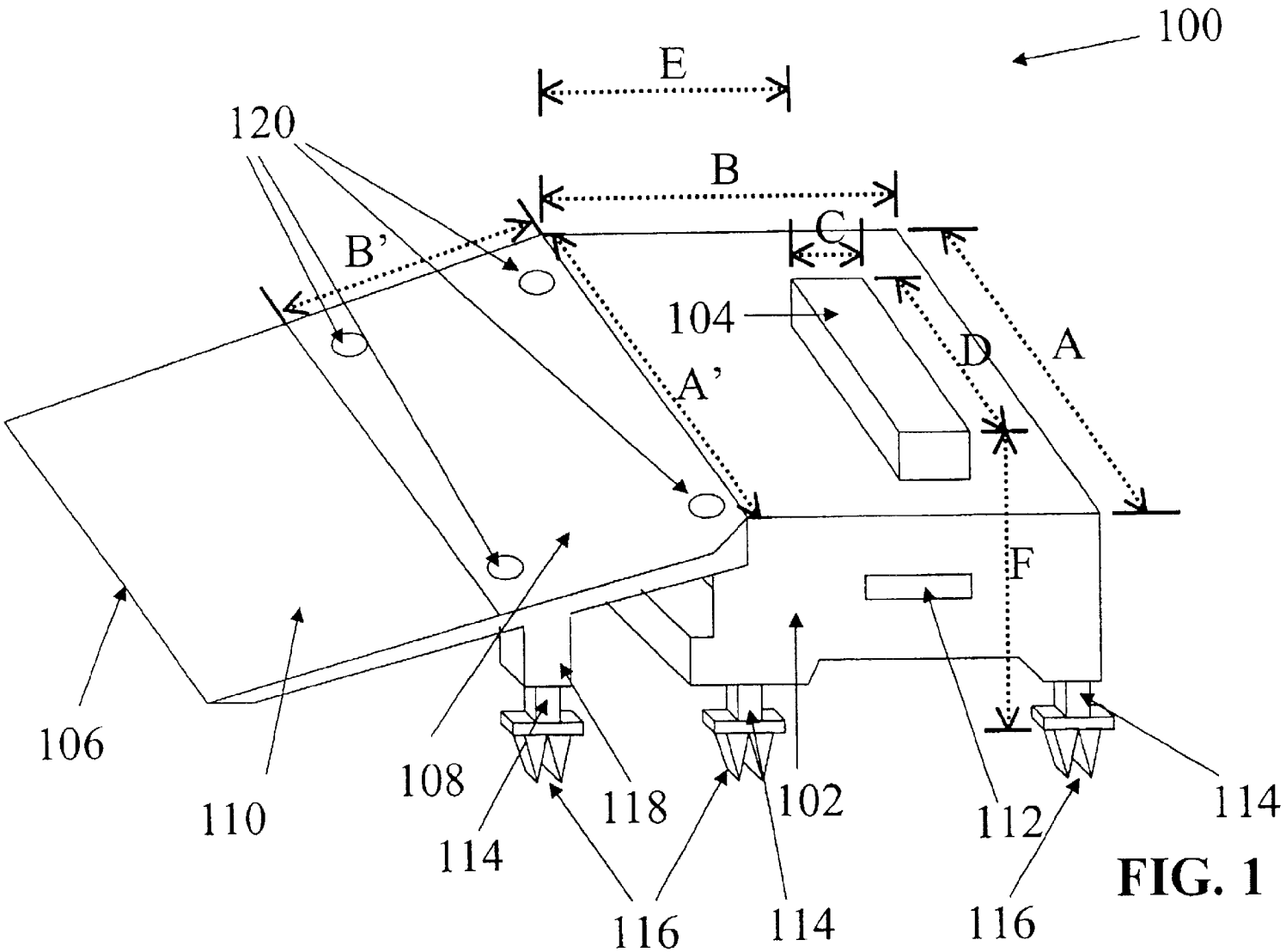
FIG. 1 illustrates a perspective view of an apparatus that suitably practices an embodiment of the invention.

Referring to FIG. 1, a portable pitching mound generally indicated by reference number 100 includes a base unit 102, a pitching rubber 104 and a collapsible ramp 106 constructed of multiple individual sections 108, 110.

The base unit 102 is preferably rectangular in shape. In one embodiment, dimension A is 76 centimeters (30 inches). The width of the base unit 102, dimension B, of the present embodiment is 84 centimeters (33 inches). It is understood that the dimensions of the base unit 102 may vary without changing the scope of the invention.

The base unit 102 is constructed from a lightweight plastic material. Alternatively, it is contemplated that the base unit 102 may be constructed from other suitable materials including, but not limited to, rubber, fiberglass, polymer, wood, metal, metal alloy and the like. It is further contemplated that the base unit 102 may be rubber coated irrespective of the base construction material used.

Referring again to FIG. 1, the base unit 102 includes a handle 112 to increase the portability of the pitching mound when in the stored position. As illustrated, handle 112 is a suitcase type handle protruding from a sidewall of the base unit 102. However, it is contemplated that the location of handle 112 may vary. It is further contemplated that the type of handle may vary in size and type from the suitcase type handle 112 illustrated in FIG. 1. For example, collapsible handles, carrying straps, cutouts, indented grips and the like may be used in place of handle 112 to effectuate the portability of the pitching mound. Moreover while the embodiment of FIG. 1 includes only one handle 112, it is contemplated that additional handles or straps may be disposed in a variety of sizes and locations on the base unit 102 to increase the mobility of the pitching mound.

As illustrated, a pitching rubber 104 is adjustably connected to the upper surface of the base unit 102. For example, in youth league rules, the pitching rubber 104 has a dimension C of 10 centimeters (4 inches) and a dimension D of 46 centimeters (18 inches). Additionally, the pitching rubber 104 is preferably adjustably mounted with a dimension E of 30 centimeters (12 inches). Alternatively, it is contemplated that the pitching rubber 104 is interchangeable with pitching rubbers of different sizes in order to comply with the rules of the specific sport and league. For example, the dimensional size of the pitching rubber 104 may vary from the youth league pitching rubber discussed above to a professional league pitching rubber which has a C dimension of 15 centimeters (6 inches) and a D dimension of 61 centimeters (24 inches). Additionally, pitching rubber 104 is adjustable thus increasing or decreasing dimension E in order to further adapt to the rules of the specific sport and league being played, for example softball, baseball, kickball and the like.

Further, the preferred embodiment includes a pitching rubber 104 constructed of a rubber or fiberglass core with a solid molded rubber cover. Alternatively, it is contemplated that the core of pitching rubber 104 may be constructed of different materials including, but not limited to, rubber, fiberglass, polymer, wood, metal, metal alloy and the like.

As shown in FIG. 1, the height F between the mounting surface of base unit 102 to the top of the pitching rubber 104 is variable to simulate various conditions and to comply with the rules of the specific sport and league being played. Continuing with the example, overall height F is 15 centimeters (6 inches) which is the official height for youth league baseball. It is contemplated that the overall height F can be adjusted to accommodate all sports and leagues as well as future league rule changes.

In one embodiment, height F is selected via adjusters 114 that may be extended or retracted to level the pitching mound as well as maintain height F. Adjusters 114 are threaded into a complimentary shaped part of base unit 102 or upper ramp section 108. One ordinarily skilled in the art can appreciate that these adjusters 114 could be replaced other devices known or to be discovered in the art including, but not limited to, spacers, spring loaded adjusters, pinned units and the like. Additionally, adjusters 114 are equipped with spikes 116 to secure the portable pitching mound to a playing surface. It is contemplated and understood that the spikes 116 could be replaced with other known or to be discovered anchoring means including non-slip pads, weighted feet and the like.

Continuing to refer to FIG. 1, the collapsible ramp 106 comprises two individual ramp sections, an upper ramp section 108 and a lower ramp section 110. Those skilled in the art will appreciate that this collapsible functionality allows the ramp 106 to reduce in length permitting the lower ramp section 110 to be received in the base unit 102 for storage while the upper ramp section 108 fits on top of the base unit 102 forming a lid. Alternately, lower ramp section 110 may be received into upper ramp section 108 for storage. In either case, the upper ramp section 108 of the preferred embodiment has dimensions A' and B' generally corresponding to dimensions A and B respectively of the base unit as described above.

The upper ramp section 108 includes two removable braces 118 disposed on the under side of the upper ramp section 108. As shown in FIG. 1, the braces 118 are equipped with adjusters 114 as described above. These braces 118 support the collapsible ramp from the pitcher's physical weight. Alternatively, the braces 118 can be disposed on the lower ramp section 110 or at an interface between the upper and lower sections.

Figure 2:
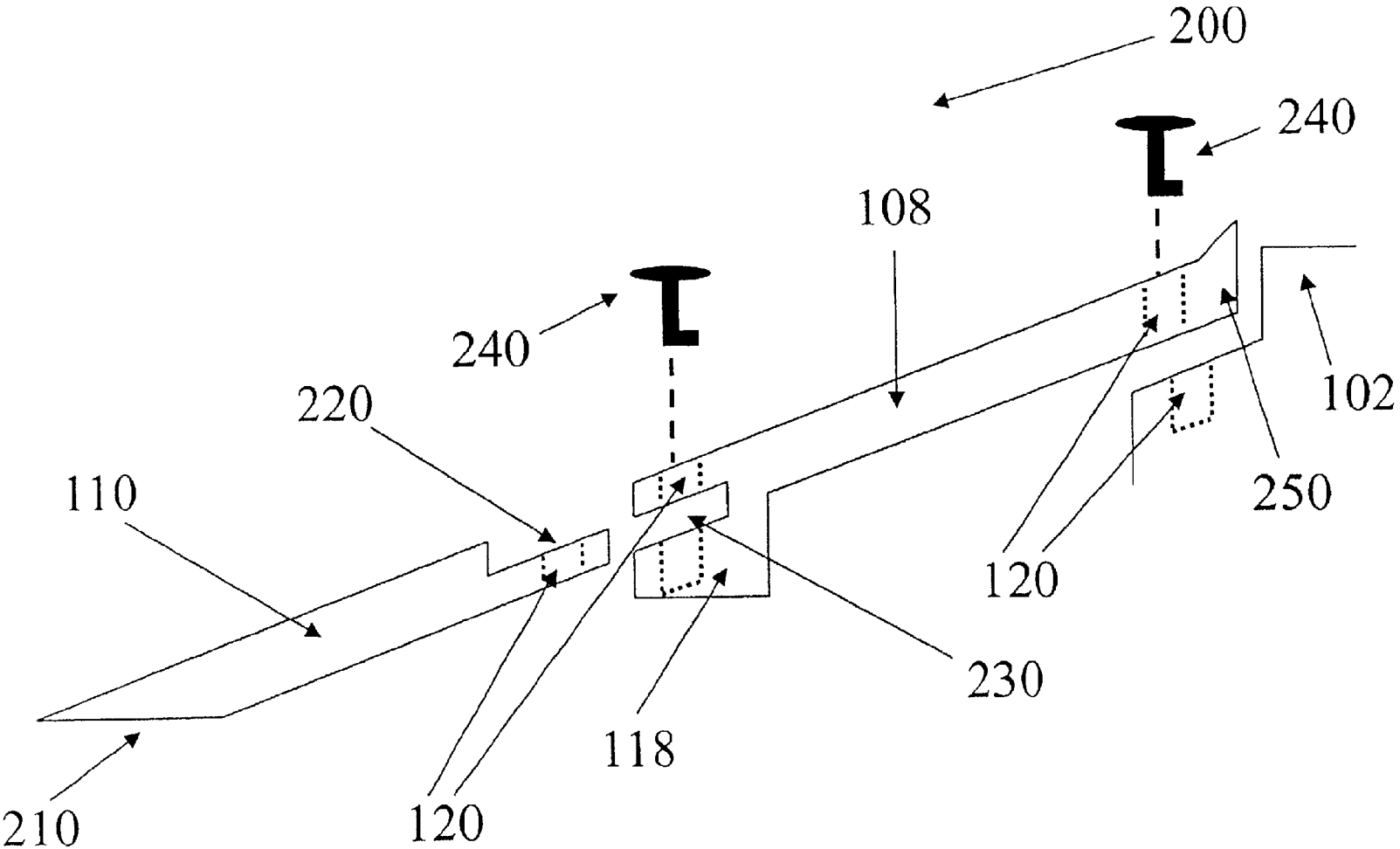
FIG. 2 illustrates a cross-sectional view of an exemplary collapsible ramp.

FIG. 2 illustrates a mound 200 having an upper ramp section 108 and a lower ramp section 110 connected together utilizing a tongue-and-groove connecting arrangement. Lower ramp section 110 includes a tapered or angled portion 210 on one end to facilitate uniform contact with the ground or surface on which the pitching mound rests. The opposite end of lower ramp section 110 includes the tongue portion 220 of the tongue-and-groove connecting arrangement. Also as shown in FIG. 2, the mating end of the upper ramp section 108 includes the groove portion 230 of the tongue-and-groove connecting arrangement. Once the two sections are physically connected forming the tongue-and-groove bond, pinholes 120 are aligned between the sections. Pins 240 are inserted through the pinholes 120 to secure the bond between the ramp sections thus forming continuity between the sections. Although the illustrated embodiment utilizes the tongue-and-groove technique of connecting the ramp sections, it is contemplated that additional connecting techniques could be used to form a continuous slope from the multiple ramp sections 108, 110. Artisans can appreciate that lower ramp section 110 may alternatively be press-fit, snapped, Velcroed, pinned and the like to upper ramp section 108.

Continued reference to FIG. 2 illustrates the same pinned arrangement to secure the upper portion 250 of the upper ramp section 108 to the base unit 102. Once the upper ramp section 108 is physically connected to the base unit 102 as shown in FIG. 2, the pinholes 120 are aligned between the sections. Pins 240 are inserted through the pinholes 120 to secure the bond between the sections. Although the preferred embodiment utilizes the pinning technique of connecting the upper ramp section 108 to the base unit 102, it is contemplated that additional connecting techniques could be used to lock the sections together. In other embodiments, the upper ramp section 108 is press-fit, snapped, Velcroed and the like to bond the connection. One skilled in the art can appreciate the numerous techniques of connecting the upper ramp section 108 to the base unit 102.

Although two ramp sections are illustrated, it is contemplated that the slope could be formed utilizing any number of collapsible ramp sections. In the alternative embodiments, the ramp sections may utilize the same locking arrangement as described herein. Additionally, all connecting arrangements described herein may be utilized regardless of the number of ramp sections included.

Figure 3:
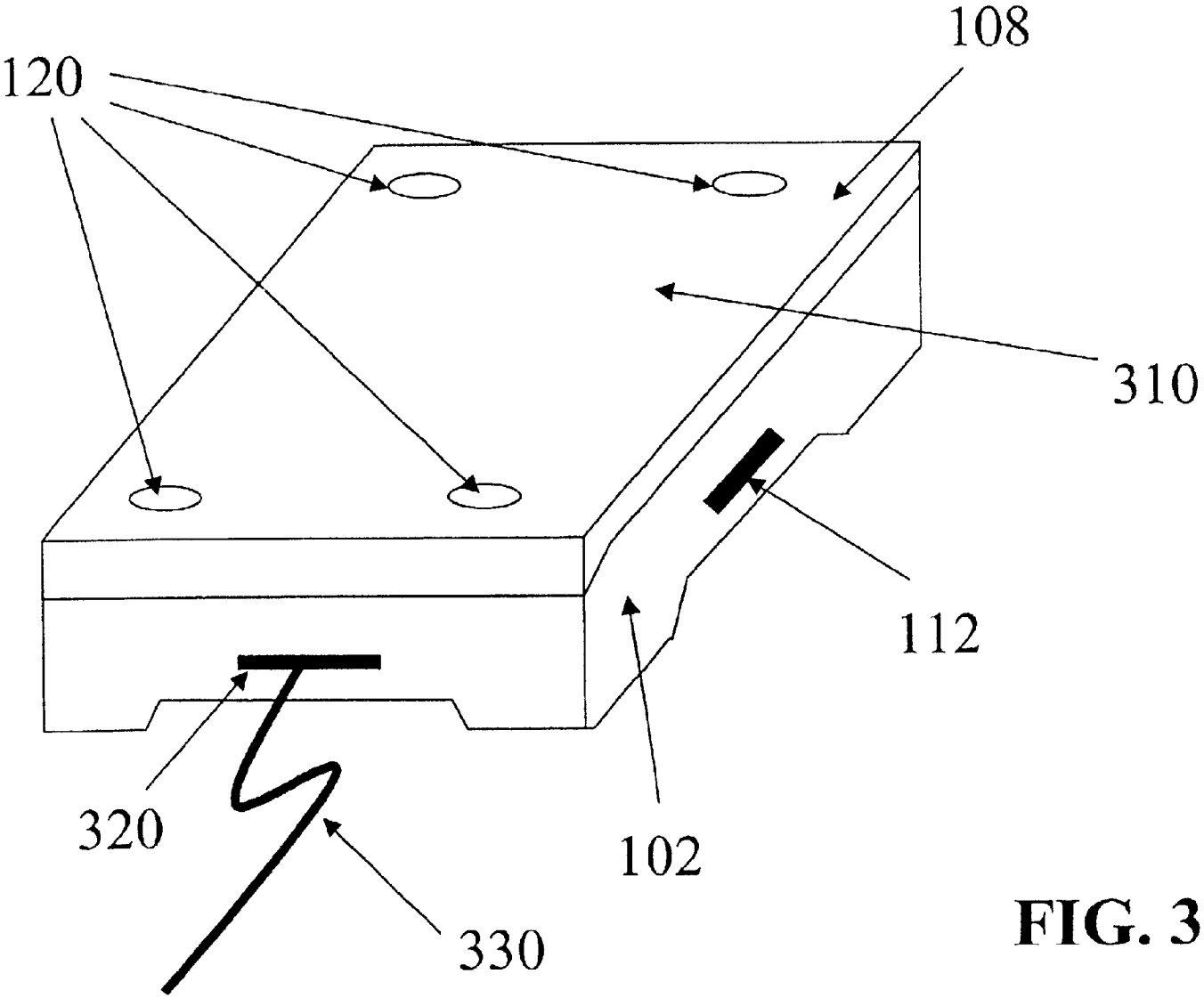
FIG. 3 illustrates a perspective view of an apparatus with a collapsible ramp in a stored position.

Now referring to FIG. 3 and as previously described herein, a lid 310 to base unit 102 is created by the upper ramp section 108 when the collapsible ramp is in the stored position. Continued reference to FIG. 3 shows that the base unit 102 of the preferred embodiment includes a measuring device 320 to accurately measure distances when assembling and setting up the pitching mound 100 on a playing surface. The measuring device 320 includes a measurement tape 330 that includes distance measurements corresponding to different sports and/or leagues.

In one embodiment, the measuring device 320 includes a conventional measuring tape 330 with at least 15.25 meters (50 feet) of retractable measuring tape. The measuring device may be manually rewindable, spring-loaded or otherwise retractable as is known to those skilled in the art. The measuring device 320 and measuring tape 330 enables accurate distancing of the portable pitching mound during set-up.

Figure 4:
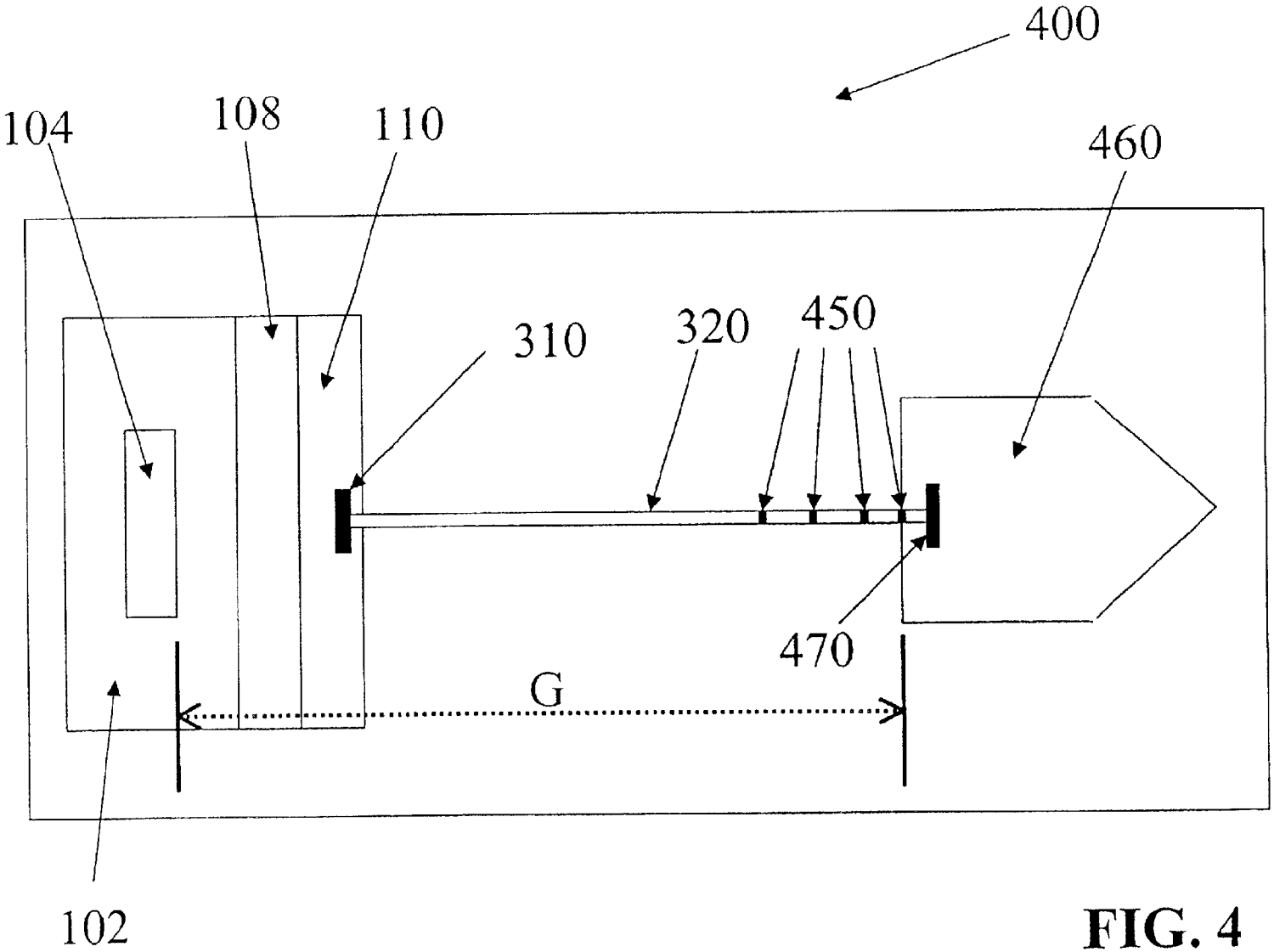
FIG. 4 illustrates a perspective view of an apparatus in relation to a home plate.

Referring to FIG. 4, the measuring tape 330 includes distance markings 450 that correspond to different sports and/or leagues. Moreover, other types of measuring equipment may be substituted with no loss of functionality, such as laser range finders, pre-measured string colored to indicate various distances and the like.

Continued reference to FIG. 4 shows the relationship of a base, such as a home plate 460 to the pitching rubber 104 in a standard set-up. Those skilled in the art will appreciate that the desired distance between the pitching rubber 104 and home plate 460 as depicted by distance G of FIG. 4 is variable and corresponds to the sport and league of the particular sport. For example, the pitching distance G measured from the front of the pitching rubber 104 to home plate 460 for a full-sized field (ages 13 and up) is 18.44 meters (60 feet 6 inches). Alternatively, the distance G is decreased to usually 14.2 meters (46 feet) for players of the age of 9 or 10. As shown in FIG. 4, the home plate 460 is equipped with a cut-out 470 capable of receiving one end of the measuring tape 330 to secure the tape while setting up the pitching mound adjustable to any length and height.

Figure 5:
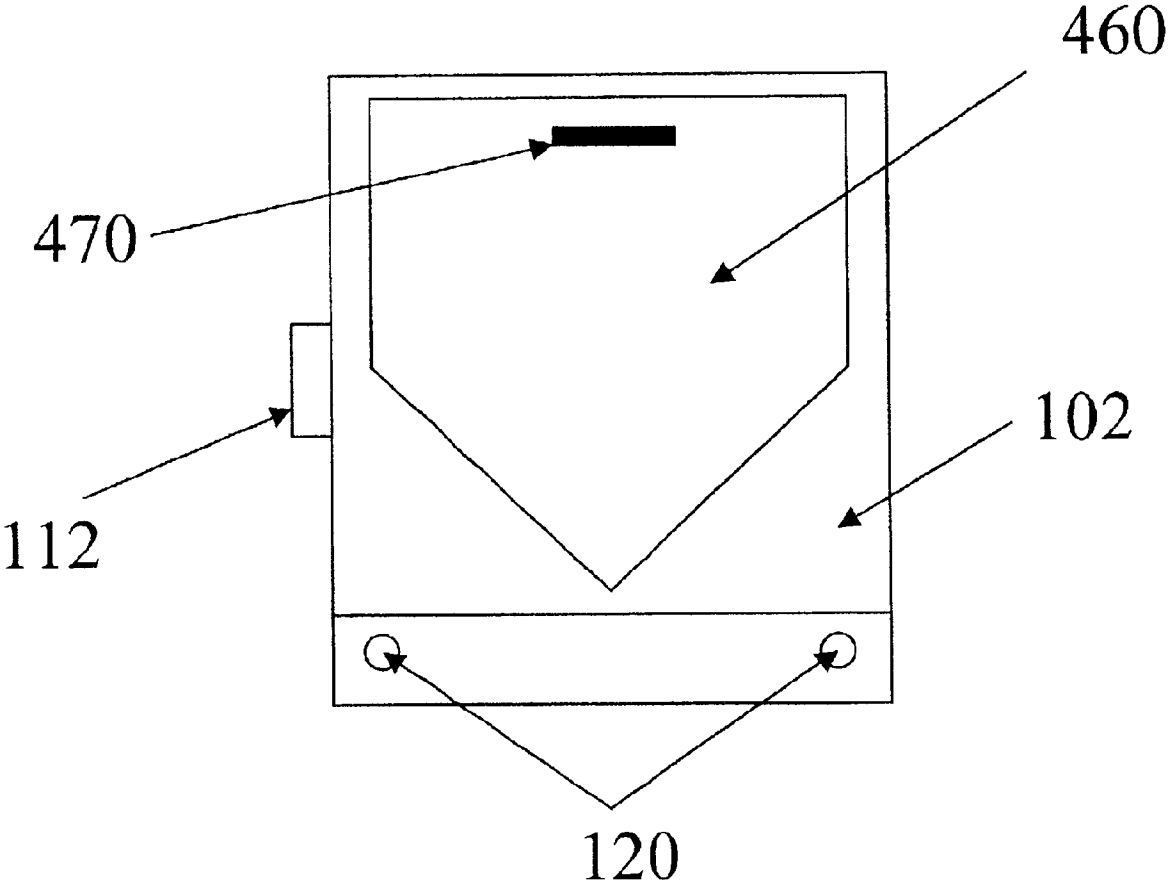
FIG. 5 illustrates a bottom view of the apparatus with a home plate in a stored position.

Now referring to FIG. 5, home plate 460 stores on the underside of the base unit 102. The home plate 460 includes Velcro which mates to Velcro on the underside of the base unit 102 causing the home plate 460 to be removably attached. One skilled in the art can appreciate that other forms of attaching may be utilized including, but not limited to, press-fit, snaps, guide rails and the like.

Figure 6:
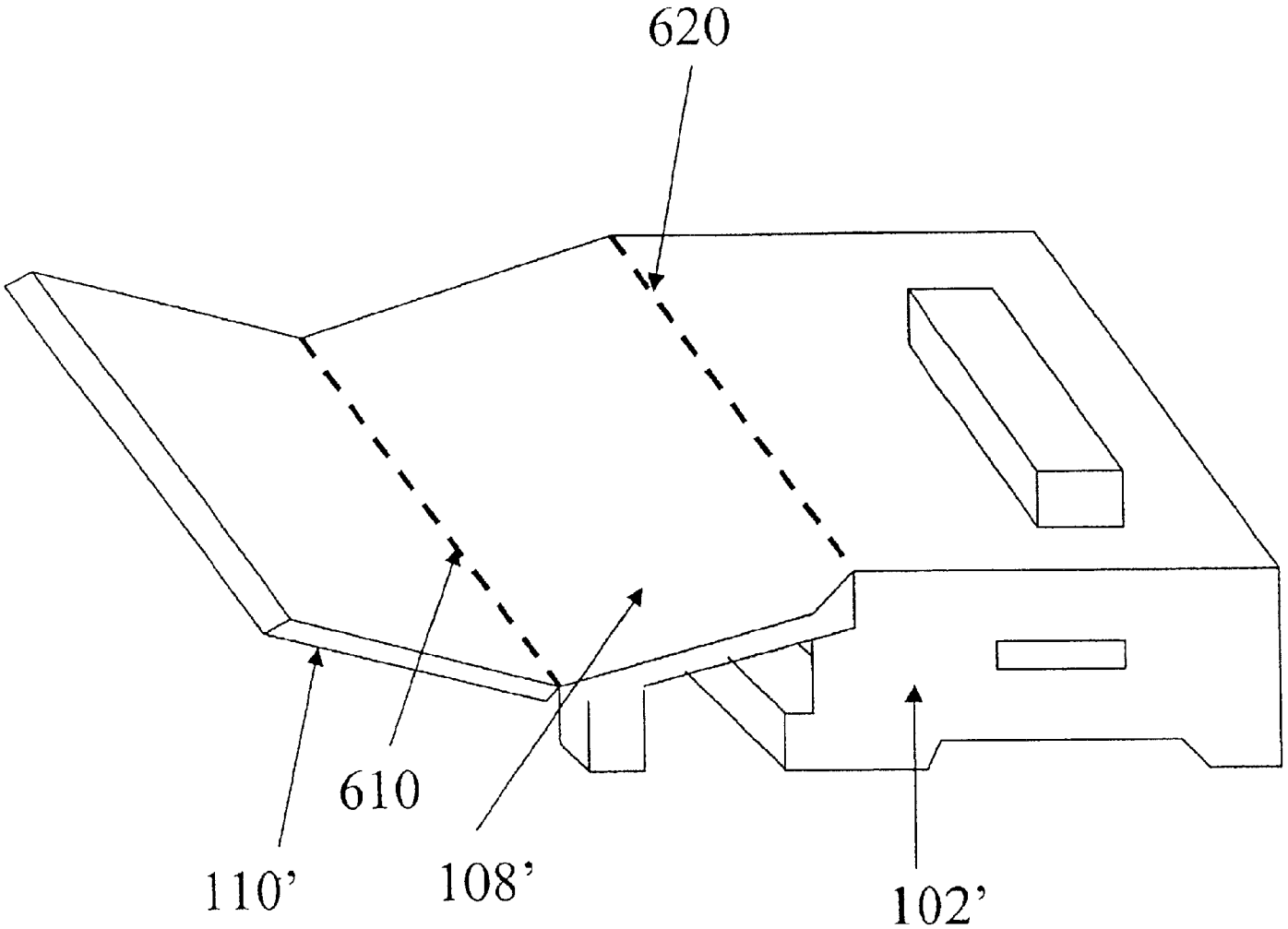
FIG. 6 illustrates a perspective view of an apparatus assembled with a hinged ramp.

Another embodiment illustrated by FIG. 6 shows that lower ramp section 110' may be permanently hinged to upper ramp section 108' allowing the collapsible ramp to fold onto itself for storage. In this embodiment, the lower ramp section 110' is connected to the upper ramp section 108' by a hinge 610. Similarly, upper ramp section 108' is connected to the base unit 102' by a hinge 620. In this embodiment, the lower ramp section 110' is hinged onto the upper ramp section 108'. The upper ramp section 108' is then folded onto the top of the base unit 102 to form a lid on the base unit 102' as shown in as previously described and illustrated in FIG. 3.

Figure 7:
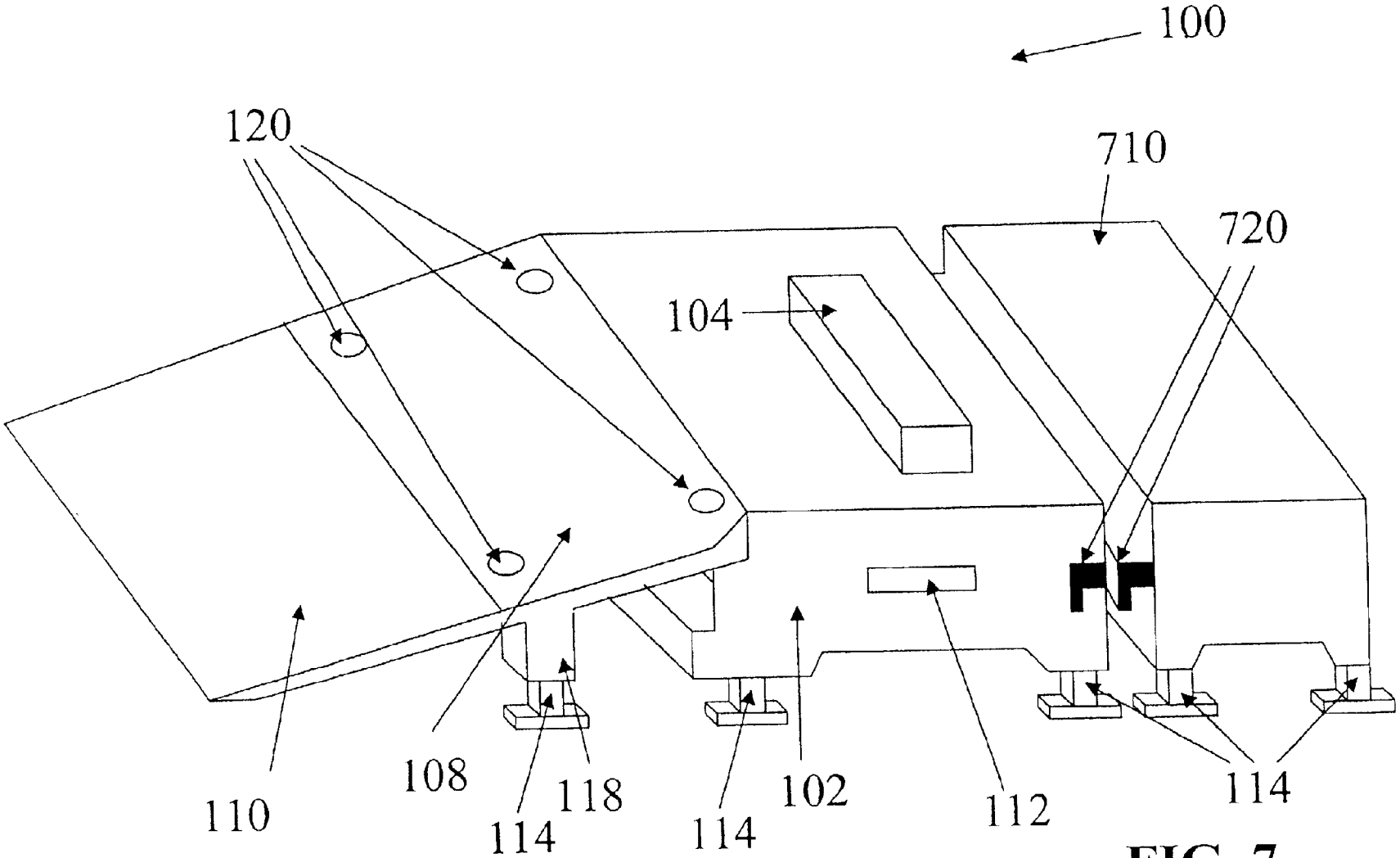
FIG. 7 illustrates a perspective view of an apparatus including an adapter.

As illustrated by FIG. 7, an optional adapter 710 connects to the base unit 102 opposite the collapsible ramp 108, 110. The adapter 710 creates additional area on the pitching surface to compensate for taller users. An L-shaped locking mechanism 720 is used to connect the adapter 710 to the base unit 102. Although an L-shaped locking mechanism 720 is illustrated, one ordinarily skilled in the art would appreciate that other attachment mechanisms may be used to fix the adapter 710 to the base unit 102.

The invention has been described with reference to the preferred embodiments and selected alternate embodiments. Modifications and alterations will become apparent to persons ordinarily skilled in the art upon reading and understanding the preceding detailed description of the invention. It is intended that the invention be construed as including all such alterations and modifications insofar as they come within the scope of the appended claims or the equivalence thereof.

Having thus set forth the preferred embodiments, the invention is now claimed to be:

1. A portable pitching mound comprising:

a base including an upper surface;

a handle connected to said base;

a ramp removably associated with the base, the ramp configured to establish an angled surface between base and a playing surface in a first position, and the ramp configured to change the angled surface to a covering for the base in a second position;

a pitching rubber connected to said upper surface; and a measuring device which measures a distance from said pitching rubber to a location on said playing surface.

2. The portable pitching mound as set forth in claim 1, further comprising a height adjusting mechanism connected to said base.

3. The portable pitching mound as set forth in claim 1, wherein said ramp is collapsible.

4. The portable pitching mound as set forth in claim 2, further comprising a movement inhibitor connected to said height adjusting mechanism.

5. The portable pitching mound as set forth in claim 1, further comprising a movement inhibitor associated with the base.

6. The portable pitching mound as set forth in claim 5, wherein said movement inhibitor comprises a non-slip pad.

7. A device comprising:

a platform;

a collapsible ramp removably connected to one side of said platform, said collapsible ramp forming a top to the platform when the device is in a stored configuration;

a pitching rubber connected to said platform;

a target removably attached to said platform opposite the collapsible ramp;

a measuring device connected to the platform capable of measuring a distance between said pitching rubber and said target when the device is deployed on a playing surface; and means for reducing slippage

8. The device of claim 7 wherein said measuring device comprises a distance marked tape.

9. The device of claim 7 wherein said means for reducing slippage comprises a spike.

10. The device of claim 7 further comprising a carrying mechanism incorporated into the device.

* * * * *